United States Patent [19]

Alison

[11] 4,065,080

[45] Dec. 27, 1977

[54] KITE REEL SYSTEM

[76] Inventor: Dave R. Alison, 21102 Brighton Ave., Torrance, Calif. 90501

[21] Appl. No.: 745,046

[22] Filed: Nov. 26, 1976

[51] Int. Cl.[2] ..... B64C 31/06

[52] U.S. Cl. ..... 244/155 A; 57/90; 242/96; 57/1 R

[58] Field of Search ..... 244/153–155; 242/96, 99, 84.2 J, 84.1 J; 57/90, 1 R, 1 UN; 46/77

[56] References Cited

U.S. PATENT DOCUMENTS

| | | | |
|---|---|---|---|
| 206,623 | 7/1878 | Scutt | 57/1 R |
| 2,143,748 | 1/1939 | Webster et al. | 57/1 R |
| 2,245,359 | 6/1941 | Perry | 57/1 R |
| 2,537,613 | 1/1951 | Allen | 242/96 X |
| 2,745,608 | 5/1956 | Walker | 46/77 X |
| 2,772,505 | 12/1956 | Kaiser | 242/96 |
| 3,048,000 | 8/1962 | Butko | 57/90 |
| 3,138,356 | 6/1964 | McClain | 244/155 A |
| 3,954,226 | 5/1976 | Pickering | 242/96 |

FOREIGN PATENT DOCUMENTS

| | | | |
|---|---|---|---|
| 720,691 | 12/1954 | United Kingdom | 242/84.2 J |

*Primary Examiner*—Galen L. Barefoot
*Attorney, Agent, or Firm*—Fraser and Bogucki

[57] ABSTRACT

A kite reel system for use with a kite having plural lengths of line attached thereto includes a shaft rotatably journaled within a handle and having a reel mounted on one end thereof and a hand operated crank coupled to the other end thereof. The kite is reeled in from a flying condition in controlled fashion by securing a ring attached to the lengths of line within a mating notch in the shaft and operating the crank to rotate the shaft and thereby twist the lengths of line around each other. The twisted lengths of line are periodically fed through a notch in the edge of the reel for winding onto the reel, then back out of the reel notch and into the ring notch as an untwisted portion thereof is encountered. The twisting and reeling procedure is repeated until the kite has been reeled in. Launching of the kite involves turning of the crank to unwind the twisted lengths of line from the reel as the kite ascends until the lengths of line are unwound from the reel, following which the ring is placed within the mating notch and the hand crank is operated to continue rotation of the shaft until the lengths of line are completely untwisted from one another.

10 Claims, 6 Drawing Figures

10
12
14
16
18
20
22
24
26
28
30
32
34
36
38
40
42
44
46
50
52
54
56
58
60
62
64
66
90
92
94
96
98
100
102

KITE REEL SYSTEM

BACKGROUND OF THE INVENTION

1. Field of the Invention

The present invention relates to reel systems for flying kites, and more particularly to reel systems for flying kites having plural lengths of line attached to the kite.

2. History of the Prior Art

It is known among kite enthusiasts that greatly improved control can be exercised over a kite through use of plural lengths of line attached to the kite rather than the more conventional single length of line. For example, a kite of conventional design can benefit from use of two lengths of line attached to the same or different locations on the kite. The opposite ends of the lengths of line when held in the opposite hands of the operator or attached to the opposite ends of a control stick or similar device enable the operator under most wind conditions to maneuver the kite to a desired location in the air and to cause the kite to undergo a series of acrobatic type maneuvers.

It is known in the art to provide a reel system for handling the storage of plural lengths of line used to control a single kite. Examples of such reel systems are provided by U.S. Pat. No. 3,138,356 of McClain, U.S. Pat. No. 3,421,722 of May et al, U.S. Pat. NO. 3,807,672 of Williams and U.S. Pat. 3,740,010 of Curtis. The McClain and May patents provide examples of systems in which dual lengths of line are wound onto and unwound from a single reel. The Curtis and Williams patents provide examples of systems in which plural lengths of line are wound on a plurality of different reels activated by a single control means.

While kites flown by plural lenghts of line enable relatively precise control to be exercised over the kite both in general terms and in terms of exercising various aerial maneuvers with the kite, such plural line systems make kite control quite difficult when launching the kite, and particularly when reeling it in. When reeling in the kite, small inequalities in the amounts by which the lengths of line are wound onto a reel or other storage means frequently cause loss of control of the kite and possible crashing and destruction of the kite. Multikite control systems such as those shown in the Curtis and Williams patents referred to above are particularly prone to this problem. Thus even where a pair of reels are mounted on a common shaft or operated by a common control there is a constant tendency for one reel to wind one of the lengths of line thereon at a rate different from that at which the other length of line is wound onto the other reel. The same problems exists in single reel kite control systems as well. Thus in systems such as those shown in the McClain and May patents noted above it is impractical or impossible to keep the lengths of line together or to otherwise wind them onto the reel at the same rate so as to prevent loss of control of the kite. Similar problems occur upon launching of the kite in the single or dual reel systems of the prior art where the lengths of line tend to unwind from single or plural reels at unequal rates.

Accordingly, it is an object of the invention to provide an improved kite reel system for flying a kite using plural lengths of line.

It is a further object in accordance with the invention to provide an improved kite reel system capable of winding in and unwinding plural lengths of line in generally uniform fashion so as to maintain control over the kite.

BRIEF SUMMARY OF THE INVENTION

Kite reel systems in accordance with the invention utilize a rotatable member for securing thereto the ends of plural lengths of line attached to a kite when it is desired to reel in the kite. The member is rotated a selected number of turns to twist selected portions of the lengths of line together, following which the twisted portion of the lengths of line is wound onto storage means. When the twisted portion of line has been wound on the storage means, the member is again rotated to provide a further twisted portion of the lengths of line, following which the twisted portion is wound onto the storage means. The procedure is repeated as many times as necessary until the kite is brought down to the operator. Launching of the kite involves a reversal in the procedure in which the twisted lengths of line are unwound from the storage means as the kite rises into the air. The member is then rotated so as to untwist the lengths of line. When the lengths of line are completely unwound from the storage means and are untwisted from each other, the lengths of line may be removed from the member and held by hand for further flying as desired. Storage of the lengths of line while in a twisted condition enables the lengths of line to be wound onto and unwound from the storage means in generally uniform fashion providing for excellent control during the reeling in and launching processes.

In one preferred embodiment of a kite reel system in accordance with the invention the storage means comprises a cylindrical reel mounted on one end of an elongated shaft rotatably journaled within a handle and having an opposite end attached to a hand operated crank. A portion of the shaft functions as a securing member by extending outwardly from the reel and terminating in a notch configured to receive a ring therein. The ring surrounds an intermediate portion of a piece of string having the opposite ends thereof attached to the kite. When it is desired to reel in a flying kite the ring is placed within the notch and the crank is turned until a selected portion of the string is twisted. The string is then fed through a notch at the end of the reel and onto the reel where it is wound in twisted form onto the reel by continued turning of the crank. When the twisted portion of the string is completely wound onto the reel, the string is fed back through the notch at the end of the reel and into the notch in the shaft for twisting of a further portion of the string upon turning of the crank. The newly twisted portion of string is then fed back through the notch for winding onto the reel, and the process is repeated as many times as necessary to bring the kite down to the operator. To launch the kite the operator holds the handle in one hand and turns the crank with the other to unwind the twisted string from the reel. When the kite reaches a desired altitude, the twisted string is fed from the reel through the notch in the end of the reel and through the notch in the shaft so that further turning of the crank causes the string to unwind.

In a different embodiment of a kite reel system according to the invention the string is secured directly to the end of the reel for twisting or untwisting thereof by a plurality of hooks mounted in spaced-apart relation on the end of the reel. Where a single length of string has the opposite ends thereof attached to a kite, the intermediate portion of the string is engaged by a pair of hooks mounted in the end of the reel so that the string can be readily twisted or untwisted by turning of the crank and accompanying rotation of the shaft and included reel.

BRIEF DESCRIPTION OF THE DRAWINGS

The foregoing and other objects, features and advantages of the invention will be apparent from the following more particular description of preferred embodiments of the invention, as illustrated in the accompanying drawings, in which.

DETAILED DESCRIPTION

Figures 1, 2, 6:
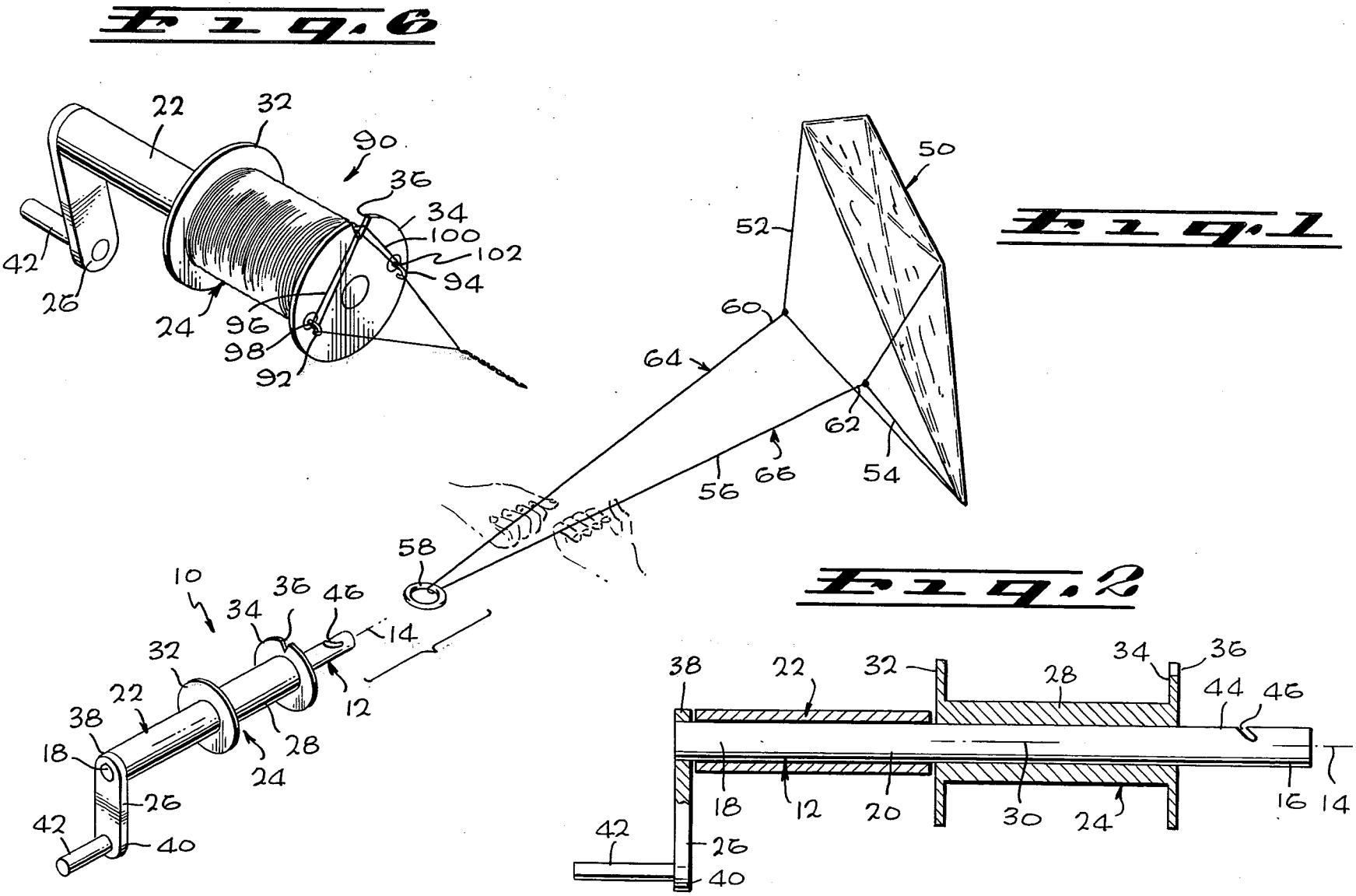
FIG. 1 is a perspective view of a kite reel system in accordance with the invention.
FIG. 2 is a sectional view of the reel arrangement used in the system of FIG. 1.
FIG. 6 is a perspective view of a different reel arrangement than that shown in FIGS. 1–5 providing an alternative way of securing plural lengths of line to the reel thereof.

Referring to FIGS. 1 and 2 a kite reel system 10 in accordance with the invention includes an elongated shaft 12 having an axis of elongation 14, a first end 16 and a second end 18. An intermediate portion 20 of the shaft 12 is rotatably journaled within a hollow, cylindrical handle 22. A cylindrical reel 24 is mounted on the end 16 of the shaft 12 on one side of the handle 22. A crank 26 is mounted on the other end 18 of the shaft 12 on the other side of the handle 22 from the reel 24.

The reel 24 has a hollow cylindrical intermediate portion 28 mounted on the outside of the shaft 12 adjacent the end 16 such that a central axis 30 of the intermediate portion 28 coincides with the axis of elongation 14 of the shaft 12. A pair of cylindrical end portions 32 and 34 having outer diameters considerably larger than the outer diameter of the cylindrical intermediate portion 28 are formed at the opposite ends of the intermediate portion 28. The end portion 32 is disposed adjacent the handle 22. The opposite end portion 34 has a generally V-shaped notch 36 formed in the outer periphery thereof. As described hereafter the reel 24 forms a means for storing twisted lengths of line.

The crank 26 is elongated in shape and has a first end 38 coupled to the end 18 of the shaft 12 and an opposite end 40 in which a handle 42 is mounted.

A portion 44 of the end 16 of the shaft 12 extends outwardly from the reel 24 opposite the handle 22 and has a ring-receiving notch 46 formed therein. As described hereafter the portion 44 of the shaft 12 defines a rotatable member for securing plural lengths of line thereto.

It will be apparent from an inspection of FIG. 2 that the handle 22 may be held in one hand of an operator while the crank 26 is turned by the other hand of the operator. Turning of the crank 26 rotates both the reel 24 and the line securing member formed by the portion 44 of the shaft 12.

In the particular embodiment of FIGS. 1–5 a kite 50 of conventional design has a pair of yokes 52 and 54 coupled thereto. A piece of string 56 extends through a ring 58 and has the opposite ends 60 and 62 thereof respectively coupled to the yokes 52 and 54. The portion of the string 56 between the end 60 thereof and the ring 58 forms a first length of line 64. The portion of the string 56 between the end 62 thereof and the ring 58 forms a second length of line 66. In the present example the separate lengths of line 64 and 66 comprise the two different halves of the single piece of string 56. These lengths of line function in the same way as the separate pieces of string typically found in prior art systems which are held in the opposite hands of the operator and in some cases are attached to the opposite ends of a control stick or similar device. In the present example, the opposite lengths of line 64 and 66 may be held in the opposite hands of the operator, in which event the ring 58 resides between the hands and is free to move along the string 56 so as not to interfere with the flying of the kite. This position is shown in FIG. 1.

Figure 3:
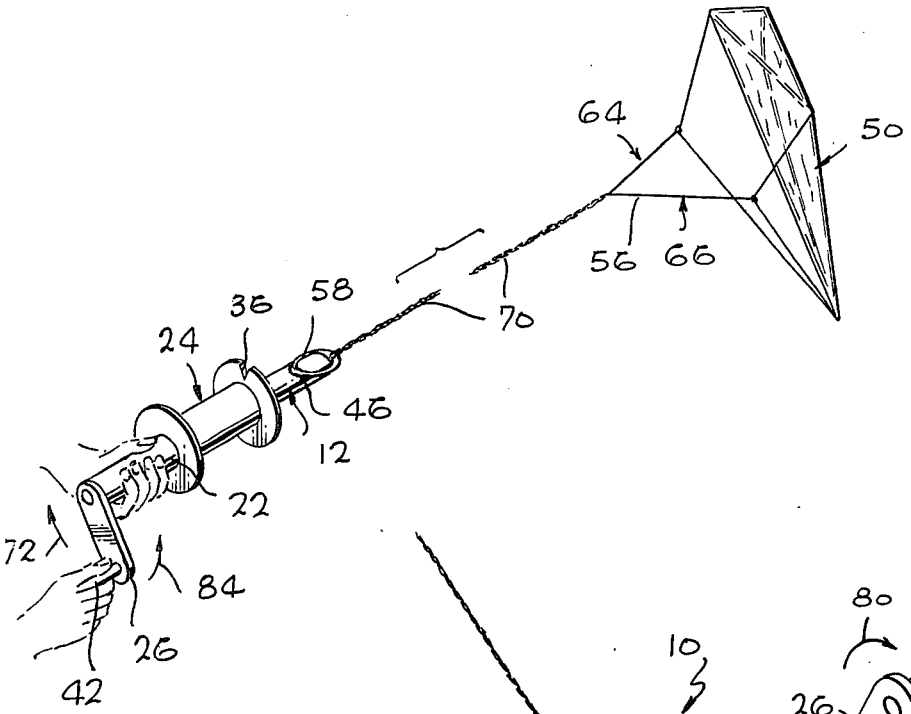
FIG. 3 is a perspective view of the kite reel system of FIG. 1 showing the manner in which plural lengths of line are twisted or untwisted.
Figure 4:
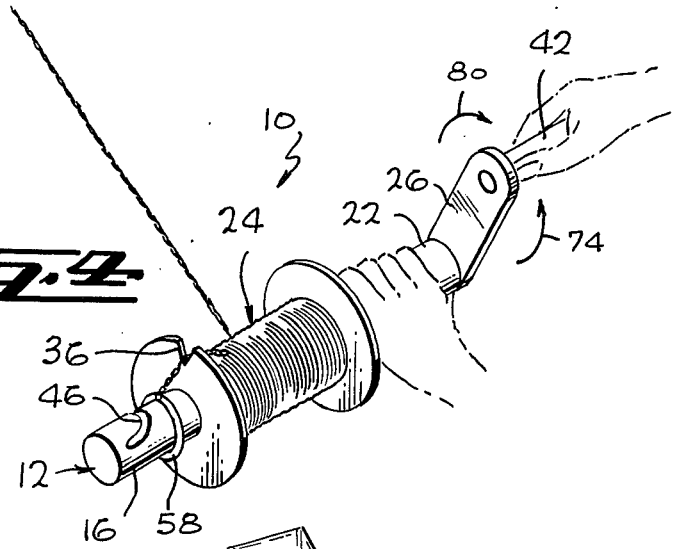
FIG. 4 is a perspectve view of the kite reel system of FIG. 1 showing the manner in which the twisted lengths of line are wound onto or unwound from the reel.

When it is desired to reel in the kite 50, the ring 58 is placed within the notch 46 in the shaft 12. By holding the handle 22 with one hand and turning the crank 26 with the other, a twisted portion 70 of the lengths of line 64 and 66 is formed as shown in FIG. 3. In the present example it is assumed that the crank 26 is turned in the direction of an arrow 72 shown in FIG. 3 to provide the twisted portion 70. The twisting of the string 56 has virtually no effect on the behavior of the kite 50 which is still in the air. Of paramount importance is the fact that twisting of the lengths of line 64 and 66 upon one another does not pull either of the lengths 64, 66 relative to the other so as to disturb the behavior of the kite. When part but not all of the lengths of line 64 and 66 have been twisted so as to form a twisted portion, the twisted portion is fed through the V-shaped notch 36 and onto the reel 24. The reel 24 is then rotated by operation of the crank 26 to wind the twisted portion onto the reel. During this operation the ring 58 may be allowed to remain within the ring-receiving notch 46 if desired. However, it is usually more convenient to remove the ring 58 and slide it onto the end 16 of the shaft 12 so that the notch 46 is left free for subsequent twisting of the lengths of line 64 and 66. As the twisted portion 70 is fed through the V-shaped notch 36 and onto the reel 24 the reel system 10 is repositioned within the operator's hand to facilitate winding of the twisted portion 70 onto the reel 24 as shown in FIG. 4. The present example assumes that the crank 26 is turned in the direction of an arrow 74 to wind the twisted portion 70 onto the reel 24. Turning of the crank 26 is continued until the twisted portion 70 is completely wound onto the reel 24. Since only the twisted portion 70 is wound upon the reel 24 the lengths of line 64 and 66 are not pulled relative to one another and the behavior of the kite which is still in the air is accordingly unaffected.

Figure 5:
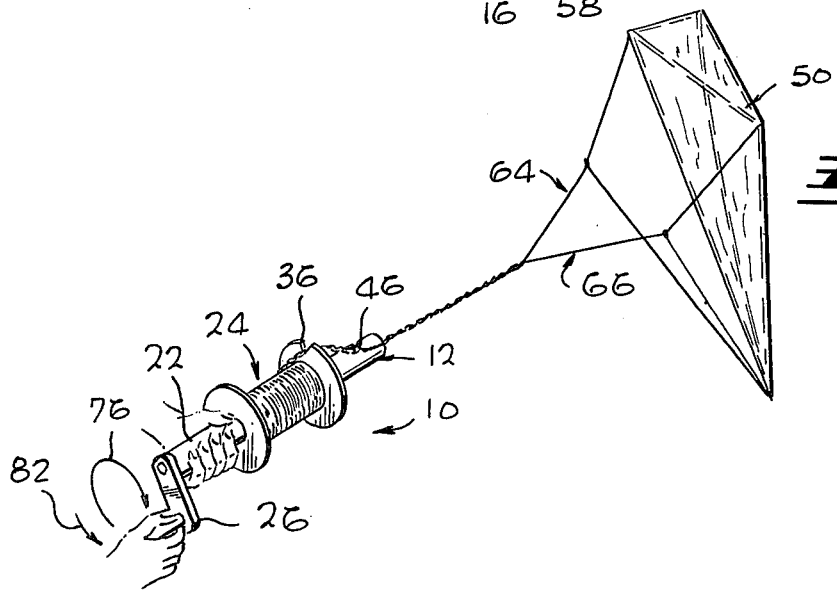
FIG. 5 is a perspective view of the kite reel system of FIG. 1 showing the manner in which successive portions of the lengths of line are twisted and then wound onto the reel.

As the end of the twisted portion 70 is reached during winding onto the reel 24, the twisted portion 70 is fed back out through the V-shaped notch 36 and into the ring-receiving notch 46. The reel system 10 is then repositioned within the operator's hands as shown in FIG. 5 and rotation of the crank 26 in the direction of an arrow 76 is commenced so as to provide a further twisted portion of the lengths of line 64 and 66. This procedure is continued until the new twisted portion is of desired length, at which point the twisted portion of string is removed from the ring-receiving notch 46 and the V-shaped notch 36 and is wound onto the reel 24 by rotating the crank 26 in the direction of the arrow 74 as shown in FIG. 4.

The procedure shown in FIGS. 4 and 5 is continued until the kite 50 is completely reeled to the ground. At no point is control of the kite lost since the lengths of line are always wound onto the reel 24 in a twisted form, and twisting does not pull one length relative to the other. The number of times in which the process of twisting the lengths and winding them onto the reel must be repeated depends on a number of factors including the length of the string and the flying conditions. Typically, however, no more than two or three repetitions are required to completely reel in a kite of conventional design under average flying conditions.

Launching of the kite involves unwinding the twisted lengths of line from the reel and then untwisting the lengths. This is illustrated by FIG. 4 except that the crank 26 is turned in an opposite direction represented by an arrow 80 so as to unwind the twisted portion 70 of the lengths of line 64 and 66 from the reel 24. In some instances it may be desirable to untwist the lengths of line 64 and 66 before they are completely unwound from the reel 24. This would be the case where it is desired to fly the kite 50 at less than the full length of the lengths of line 64 and 66. Also, where flying conditions or other factors dictate, it may be desirable to untwist the lengths of line before they are completely unwound from the reel 24. In either event the twisted portion 70 which has been unwound from the reel 24 is fed through the V-shaped notch 36 and the ring-receiving notch 46. The kite reel assembly 10 is then held as shown in FIG. 5 while the crank 26 is turned in the direction of an arrow 82 to untwist the lengths of line 64 and 66. When the lengths of line 64 and 66 are untwisted down to the reel system 10, the lengths are removed from the notches 46 and 36 and the remaining twisted portion is unwound from the reel 24 as shown in FIG. 4. When the lengths of line 64 and 66 are completely unwound from the reel 24, the ring 58 is placed within the ring-receiving notch 46 and the crank 26 is turned in the direction of an arrow 84 as shown in FIG. 3 to untwist the lengths of line 64 and 66. When the lengths of line 64 and 66 are completely untwisted from each other, the ring 58 is removed from the notch 46 and the lengths are held in both hands for flying as shown in FIG. 1.

In most instances the kite may be launched by completely unwinding the lengths of line 64 and 66 from the reel 24 before untwisting is begun. In that event the crank 26 is turned in the direction of the arrow 80 shown in FIG. 4 until the lengths of line 64 and 66 are completely unwound from the reel 24. Thereafter, the ring 58 is placed within the ring-receiving notch 46 and the crank 26 is turned in the direction of the arrow 84 as shown in FIG. 3 so as to untwist the lengths of line 64 and 66.

While the crank 26 provides a convenient and effective way of turning the shaft 12 and the included reel 24, it as well as the handle 22 can be eliminated in the event a low cost reel system is desired. In such a low cost system the shaft 12 is turned by hand to twist the lengths of line and the twisted lengths of line are wound onto the reel 24 by holding the shaft 12 in one hand and manually winding the twisted lengths of line around the reel 24 with the other hand.

In the embodiment of FIGs. 1–5 the lengths of line 64 and 66 comprise the single piece of string 56 having the ring 58 thereon to facilitate securing of the lengths to the reel system 10 for twisting and untwisting. However, kites having more than two lengths of line can be used in accordance with the invention by employing other appropriate means to secure the ends of the lengths of line opposite the kite to the reel system. Moreover, the lengths of line need not be comprised of a single piece of string as in the embodiment of FIGs. 1–5. Instead each length of line may comprise a separate piece of string having an end opposite the kite adapted to be secured to the reel system.

An alternative embodiment in accordance with the invention is a reel system 90 which is shown in FIG. 6. The reel system 90 is identical in construction to the reel system 10 of FIGS. 1–5 except that the shaft 12 terminates at the end portion 34 of the reel 24. The end portion 34 has a pair of opposite hooks 92 and 94 secured thereto. A first length of line 96 terminates in a loop 98 which is shown in FIG. 6 being secured over the hook 92. A second length of line 100 terminates in a loop 102 which is shown secured to the hook 94.

When the kite is being flown the lengths of line 96 and 100 are held in the hands of the operator near the loops 98 and 102. When it is desired to reel in the kite, the loops 98 and 102 are secured on the hooks 92 and 94 and the crank 26 is turned to twist a portion of the lengths of line 96 and 100. The twisted portion is wound on the reel 24 by pulling the ends of the lengths of line 96 and 100 adjacent the loops 98 and 102 through the V-shaped notch 36 and onto the reel 24. When the twisted portion of the lengths of line 96 and 100 is completely wound on the reel 24, the lengths of line 96 and 100 are fed out through the V-shaped notch 36 where they are separated and placed around the hooks 92 and 94 as shown in FIG. 6. The crank 26 is then turned to provide further twisting of the lengths of line 96 and 100 When it is again desired to wind the twisted portion onto the reel 24 the lengths of line 96 and 100 are removed from the hooks 92 and 94 and are pulled out of the V-shaped notch 36 so that the twisted portion may be wound onto the reel 24. The process is repeated until the kite is completely reeled in.

Launching of a kite using the reel system 90 of FIG. 6 involves turning the crank 26 to unwind the twisted lengths of line 96 and 100 from the reel 24. When the lengths of line 96 and 100 are completely unwound from the reel 24, the loops 98 and 102 are secured over the hooks 92 and 94 and the crank 26 is turned until the lengths of line 96 and 100 are untwisted. At that point the loops 98 and 102 may be removed from the hooks 92 and 94 and held in opposite hands for flying of the kite.

Although the reel system 90 is shown and described in connection with lengths of line 96 and 100 comprising separate pieces of string terminating in loops 98 and 102, such system can also be used with a single piece of string forming a pair of lengths of line as in the case of the string 56 of FIGS. 1–5. Where a single piece of string is used, it is looped over both of the hooks 92 and 94 for twisting and is allowed to remain on the hooks 92 and 94 as the twisted lengths of line are fed through the V-shaped notch 36 for winding in the reel 24 and back through the notch 36 and the hooks 92 and 94 for further twisting.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A kite reel system for use with a kite having the opposite ends of a length of line coupled thereto comprising:

a first handle of hollow, generally cylindrical configuration;

a shaft journaled within the first handle and capable of undergoing rotation relative to the first handle, the shaft having an axis of elongation and opposite first and second ends on opposite sides of and outside of the first handle;

a reel having a cylindrical intermediate portion having a central axis and a pair of cylindrical end portions disposed at opposite ends of the intermediate portion, the end portions having a larger diameter than and extending radially outwardly from the intermediate portion, the reel being coupled to the first end of the shaft such that the axis of elongation of the shaft is coincident with the central axis of the intermediate portion of the reel;

means coupled to the reel opposite the first handle and capable of releasably securing thereto an intermediate portion of a length of line having the opposite ends thereof coupled to a kite, said means including means for temporarily securing a twisted portion of the length of line adjacent the axis of elongation of the shaft;

a crank having a first end thereof coupled to the shaft, the crank extending radially outwardly from the shaft and terminating in an opposite second end; and a second handle coupled to the second end of the crank.

2. The invention set forth in claim 1, wherein one of the pair of cylindrical end portions of the reel adjacent the means capable of securing has a V-shaped notch in the outer periphery thereof.

3. The invention set forth in claim 2, wherein the means capable of securing comprises a pair of hooks mounted on an end of the reel opposite the first handle.

4. The invention set forth in claim 1, wherein the intermediate portion and the pair of end portions of the reel have hollow interiors for receiving the first end of the shaft to mount the reel on the shaft and the first end of the shaft extends outside of the reel opposite the first handle and has a notch therein defining the means capable of securing.

5. The invention set forth in claim 4, further including a hollow ring having the length of line extending therethrough, the ring being adapted to fit within said notch.

6. A method of flying a kite having the first end of each of a plurality of lengths of line attached thereto, each of the lengths of line having an opposite second end, comprising the steps of:

1. securing the second ends of the lengths of line to a member and rotating the member while the kite is in flight to twist the lengths of line together over a portion thereof;
2. winding the twisted portion of the lengths of line onto storage means;
3. again rotating the member to twist at least a portion of any remaining untwisted portion of the lengths of line together;
4. winding any twisted portion of the lengths of line produced by step 3) above mounted onto the storage means; and
5. repeating steps 3) and 4) above as necessary until the lengths of line are substantially completely twisted together and wound onto the storage means.

7. The invention set forth in claim 6, comprising the further steps of:

6. unwinding the twisted lengths of line from the storage means as the kite is launched into the air; and
7. rotating the member until the lengths of line are substantially completely untwisted from each other.

8. A kite reel system for use with a kite having two different lengths of line coupled thereto comprising:

an elongated structure rotatable about an axis along the length thereof;

handle means extending along a portion of the length of the elongated structure;

line storage means encircling the elongated structure at a location along the length thereof; and means for releasably coupling two different lengths of line to the elongated structure, and including means for temporarily securing a twisted portion of the two different lengths of line at or adjacent said axis.

9. The invention set forth in claim 8, wherein the means for releasably coupling comprises a notch in the elongated structure adjacent the axis and a ring having the two different lengths of line secured thereto and adapted to reside within the notch.

10. The invention set forth in claim 8, wherein the means for releasably coupling comprises a pair of hooks mounted on the elongated structure on opposite sides of the axis.

* * * * *